US011359782B2

(12) United States Patent
Caprara

(10) Patent No.: US 11,359,782 B2
(45) Date of Patent: Jun. 14, 2022

(54) DOWNWARD ILLUMINATING LIGHTING APPARATUS AND LAMP POST COMPRISING A LIGHT POLE MODULE THEREOF

(71) Applicant: Schreder S.A., Brussels (BE)

(72) Inventor: Roxane Caprara, Neupre (BE)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 17/250,027

(22) PCT Filed: May 8, 2019

(86) PCT No.: PCT/EP2019/061879
§ 371 (c)(1),
(2) Date: Nov. 6, 2020

(87) PCT Pub. No.: WO2019/215265
PCT Pub. Date: Nov. 14, 2019

(65) Prior Publication Data

US 2021/0215308 A1 Jul. 15, 2021

(30) Foreign Application Priority Data

May 8, 2018 (BE) ..... 20185296

(51) Int. Cl.
*F21S 8/08* (2006.01)
*F21V 5/00* (2018.01)
(Continued)

(52) U.S. Cl.
CPC ..... *F21S 8/085* (2013.01); *F21V 5/007* (2013.01); *F21V 5/04* (2013.01); *F21V 7/0083* (2013.01);
(Continued)

(58) Field of Classification Search
CPC ..... F21S 8/085; F21S 8/083; F21S 8/088; F21W 2131/103; F21V 7/0083;
(Continued)

(56) References Cited

U.S. PATENT DOCUMENTS 7,934,851 B1 5/2011 Boissevain et al.
7,985,004 B1 7/2011 Schach et al.
(Continued)

FOREIGN PATENT DOCUMENTS

CA 2630113 A1 10/2009
EP 3211297 A1 8/2017
(Continued)

OTHER PUBLICATIONS

PCT International Search Report and Written Opinion, PCT International Application No. PCT/EP2019/061879, dated Jun. 6, 2019.

*Primary Examiner* — Erin Kryukova
(74) *Attorney, Agent, or Firm* — McDonnell Boehnen Hulbert & Berghoff LLP

(57) ABSTRACT

A lighting apparatus comprising: a mounting substrate being arranged in the lighting apparatus at an angle below 45° with respect to a vertical direction; a plurality of light sources mounted on a lower or vertical surface of the mounting substrate such that at least two light sources are at a different height; a plurality of lens elements provided to the mounting substrate such that each of the light sources is provided with a corresponding lens element; at least two reflector elements provided to the at least two light sources, such that each of the at least two reflector elements has a reflective surface facing the mounting substrate; wherein each of the at least two reflector elements extends between a first edge, located above a corresponding light source as seen in a vertical direction, and a second edge, located below a corresponding light source as seen in a vertical direction.

20 Claims, 8 Drawing Sheets

(51) Int. Cl.

| | |
|---|---|
| ***F21V 5/04*** | (2006.01) |
| ***F21V 7/00*** | (2006.01) |
| ***F21V 23/04*** | (2006.01) |
| ***F21V 13/04*** | (2006.01) |
| ***F21Y 105/10*** | (2016.01) |
| ***F21W 131/103*** | (2006.01) |

(52) U.S. Cl.
CPC ..... *F21V 13/04* (2013.01); *F21V 23/0435* (2013.01); *F21W 2131/103* (2013.01); *F21Y 2105/10* (2016.08)

(58) Field of Classification Search
CPC . F21V 13/04; F21V 5/007; F21V 5/04; F21V 5/0435; F21Y 2105/10; F21Y 2107/00; F21Y 2107/20; F21Y 2107/30; F21Y 2107/40; F21Y 2107/50; F21Y 2107/80
See application file for complete search history.

(56) References Cited

U.S. PATENT DOCUMENTS 9,400,087 B2 * 7/2016 Marquardt ..... F21V 7/0066
9,903,561 B1 * 2/2018 Chen ..... F21V 7/0083
2005/0110649 A1 5/2005 Fredericks et al.
2009/0225543 A1 * 9/2009 Jacobson ..... F21V 29/763 362/247
2010/0073925 A1 * 3/2010 Vissenberg ..... G02B 6/0031 362/235
2010/0295071 A1 11/2010 Tsai et al.
2011/0194281 A1 * 8/2011 Josefowicz ..... F21V 7/0083 362/235
2012/0026737 A1 * 2/2012 Dine ..... F21V 19/04 362/247
2013/0051020 A1 2/2013 Yasuoka
2013/0107518 A1 * 5/2013 Boyer ..... F21V 7/09 362/235
2014/0063802 A1 3/2014 Garcia
2015/0330609 A1 * 11/2015 Ahrari ..... F21S 2/005 362/238
2015/0345741 A1 12/2015 Sferra et al.
2017/0030548 A1 * 2/2017 Hirai ..... F21V 5/08
2017/0038521 A1 * 2/2017 Luo ..... F21S 43/249

FOREIGN PATENT DOCUMENTS

FR 2961581 A3 * 12/2011 ..... F21V 23/0442
WO WO-2005078336 A1 * 8/2005 ..... F21S 9/022
WO WO-2011058387 A1 * 5/2011 ..... F21V 7/09
WO WO-2015124438 A1 * 8/2015 ..... F21V 14/02

* cited by examiner

DOWNWARD ILLUMINATING LIGHTING APPARATUS AND LAMP POST COMPRISING A LIGHT POLE MODULE THEREOF

CROSS-REFERENCE TO RELATED APPLICATION

The present application is a national stage entry of PCT/EP2019/061879 filed on May 8, 2019, which claims priority to BE 20185296, filed on May 8, 2018, the contents of each of which are hereby incorporated by reference.

FIELD OF INVENTION

The field of invention relates to lighting apparatus, in particular lighting apparatus in the form of outdoor luminaires. Particular embodiments relate to downward illuminating lighting apparatus and downward illuminating lighting modules for use in modular lamp posts.

BACKGROUND

Typically, lighting equipment in outdoor places uses downward-facing luminaire heads mounted substantially horizontally, especially for road uses. The need to place the luminaire heads downward-facing requires mounting them relatively high and involves heavy logistical operations. One needs a lighting apparatus allowing a lower mounting position providing downward illumination while being less demanding logistically.

Several solutions exist for vertically mounted luminaire heads with reflectors. However, vertically mounted luminaire heads have the disadvantage of causing glare to users. Hence there is a need for a lighting apparatus redirecting light effectively and preventing or reducing glare.

SUMMARY

The object of embodiments of the invention is to provide a lighting apparatus whose light distribution is directed substantially downward while the mounting plate of the light sources of the lighting apparatus is being substantially vertical or at an angle. More in particular, embodiments of the invention aim to provide a lighting apparatus for which the light is effectively redirected, and glare is reduced.

According to a first aspect of the invention, there is provided a lighting apparatus. The lighting apparatus comprises:

- a mounting substrate being arranged in the lighting apparatus at an angle below 45° with respect to a vertical direction;
- a plurality of light sources mounted on a lower or vertical surface of the mounting substrate such that at least two light sources of the plurality of light sources are at a different height;
- a plurality of lens elements provided to the mounting substrate such that each of the plurality of light sources is provided with a corresponding lens element;
- at least two reflector elements provided to the at least two light sources, such that each of the at least two reflector elements has a reflective surface facing the mounting substrate;
- wherein each of the at least two reflector elements extends between a first edge and a second edge;

- wherein each of the at least two reflector elements first edge is being located above a corresponding light source of the at least two light sources as seen in a vertical direction;
- wherein each of the at least two reflector elements second edge is being located below a corresponding light source of the at least two light sources as seen in a vertical direction.

A solution to prevent or reduce glare to users in a lighting apparatus having a mounting plate of the light sources substantially vertical or at an angle is to block the light emitted above a predetermined angular arc. However blocking the emitted light decreases the potential illumination efficiency of the lighting apparatus. This problem is overcome by a lighting apparatus as defined above.

When the mounting substrate is oriented vertically the plurality of light sources are mounted on a vertical surface of the mounting substrate, and when the mounting substrate is at an angle with respect to a vertical direction the plurality of light sources are mounted on a lower surface of the mounting substrate. The light emitted by the plurality of light sources mounted on the vertical or lower surface of the mounting substrate will be emitted in a large arc centered on a substantially horizontal direction or a downward direction depending on the angle of the mounting substrate with respect to a vertical direction.

Because of the presence of the at least two reflector elements, part of the light emitted by the plurality of light sources and impinging on the at least two reflector elements is being reflected and redirected. Due to the positioning of the reflective surface and of the edges of the at least two reflector elements above and below a corresponding light source, respectively, the portion of the light diffused upward is redirected downward by reflecting onto the reflective surface of the reflector element facing the corresponding light source positioned under it. Thus the glare problem is reduced or eliminated. Moreover, the redirected light is adding its illuminance to the light emitted below the angular arc covered by the reflector element.

The plurality of light sources is mounted at different heights. Therefore, the corresponding lighting pattern will be projected further on the ground to be illuminated by the at least two reflector elements than if the light sources were mounted at the same height. Providing at least two reflector elements to the at least two light sources at a different height improves the accuracy and efficiency of the light redirection since there will be different reflector elements corresponding to the different heights of the at least two light sources.

Having the plurality of lens elements corresponding to the plurality of light sources allows an improved shaping of the light distribution emitted by the plurality of light sources which is further patterned by the addition of the at least two reflector elements. Thus a downward illuminating lighting apparatus is obtained by effectively using light redirection from the combined use of suitably-placed reflector elements and lens elements.

Additionally, due to the position of the mounting substrate, potential mounting locations are opened for luminaires comprising the described lighting apparatus with respect to downward-facing overhead luminaire heads. In other embodiments, the plurality of lens elements can be further designed to improve the light redirection when associated with the at least two reflector elements.

According to an exemplary embodiment, the mounting substrate is a PCB.

According to a preferred embodiment, the lighting apparatus further comprises a lens plate integrating the plurality of lens elements; wherein the plurality of reflector elements is mounted on the lens plate.

In this manner, the plurality of lens elements can be more easily replaced in case of maintenance.

Moreover the lens plate can provide a mounting support for the at least two reflector elements, which removes the need for an additional separate mounting support. In an exemplary embodiment, mounting positions are provided next to each of the plurality of light sources for a precise positioning of the at least two reflector elements.

According to an exemplary embodiment, the lighting apparatus further comprises a frame integrating the at least two reflector elements.

In this way, the at least two reflector elements are linked and are mounted in a faster manner. In an exemplary embodiment the frame and the at least two reflector elements are in a different material, e.g. a plastic frame integrating metallic reflector elements. In another exemplary embodiment, the frame and the at least two reflector elements are made of the same material, e.g. both frame and the at least two reflector elements are metallic. In a particular exemplary embodiment, the frame and the at least two reflector elements are integrally formed. In another particular exemplary embodiment, the at least two reflector elements are removably integrated to the frame such that maintenance and interchangeability are facilitated.

According to a preferred embodiment, the frame is mounted on the mounting substrate and extends around the plurality of light sources.

In this manner, the frame is independent from the plurality of lens elements and can be precisely positioned with respect to the plurality of light sources provided to the mounting substrate. Thus the first and second edge of the at least two reflector elements can be adjusted accurately above and below, respectively, the corresponding light sources. In an exemplary embodiment electrical contact is prevented between the metallic traces of the mounting substrate and the frame integrating the at least two reflector elements.

According to an exemplary embodiment, the frame is mounted on the lens plate.

In this way, the frame is more accurately positioned with respect to the plurality of lens elements.

According to a preferred embodiment, the plurality of light sources is arranged as an array of light sources with at least two rows of light sources and two columns of light sources.

In this manner, the mounting and connecting of the plurality of light sources on the mounting substrate is simplified by the organized arrangement of the plurality of light sources.

According to an exemplary embodiment, one or each of the at least two reflector elements corresponds to at least two adjacent light sources of a row of light sources, preferably all the light sources of a row of light sources.

In this way, less parts needs to be manufactured and the overall design of the reflector elements is made simpler to realize.

According to a preferred embodiment, one or each of the at least two reflector elements corresponds to one lens element.

In this manner, the potential illumination of the lighting apparatus can be increased by a reflector element efficiently dedicated to a lens element.

According to an exemplary embodiment, one or each of the at least two reflector elements is at a tangential angle with respect to the mounting substrate at the first edge of one or each of the at least two reflector elements, said tangential angle being between 90° and 170° with respect to the mounting substrate, preferably between 100° and 160°, more preferably between 110° and 150° with respect to the mounting substrate. The tangential angle is such that each reflector element is inclined in a downward direction with respect to the mounting substrate.

In this way, light emitted above a certain angular arc, more particularly light emitted above a substantially horizontal level, is blocked by the at least two reflector elements. Additionally, light blocked by the at least two reflector elements is reflected downward. The chosen angle for the at least two reflector elements, with respect to the mounting substrate, associated with the angle at which the mounting substrate is provided with respect to a vertical direction, determines the direction into which the light is redirected. The shape of the reflective surface of the at least two reflector elements, e.g. curved, flat, polygonal, may be designed for obtaining a desired light distribution.

According to a preferred embodiment, one or each of the at least two reflector elements first edge is being located at a distance above a corresponding light source as seen in a vertical direction of at least 2%, more preferably at least 3%, even more preferably at least 5% of the distance between the first edge and the second edge, e.g. at least 10%; and/or one or each of the at least two reflector elements second edge is being located at a distance below a corresponding light source as seen in a vertical direction of at least 2%, more preferably at least 3%, even more preferably at least 5% of the distance between the first edge and the second edge, e.g. at least 10%. Preferably, one or each of the at least two reflector elements first edge is being located at a distance above a corresponding light source as seen in a vertical direction of less than 50% of the distance between the first edge and the second edge; and/or one or each of the at least two reflector elements second edge is being located at a distance below a corresponding light source as seen in a vertical direction of less than 50% of the distance between the first edge and the second edge.

In this way, the at least two reflector elements are designed to reflect light emitted within a predetermined angular arc. Additionally the position of the first and second edge can be adapted to the lens elements and to the density of the light sources provided to the mounting substrate with respect to the desired usage.

According to a preferred embodiment, a first reflector element of the at least two reflector elements is at a first obtuse tangential angle with respect to the mounting substrate lower than a second obtuse tangential angle of a second reflector element of the at least two reflector elements provided at a lower height. Preferably the difference between the first and second tangential angle is at least 1%, more preferably at least 2%, e.g. between 1 and 5%. The first and second obtuse tangential angle are such that each reflector element is inclined in a downward direction with respect to the mounting substrate, with the second reflector element being inclined more downward than the first reflector element.

In this manner, a light source located higher on the mounting substrate has its light projected further on the ground by the first reflector element than a light source located lower. The light distribution of the lighting apparatus on the ground is thus further tailored by the progressive angular positioning of the at least two reflector elements. More in particular, the light distribution on the ground may be more homogeneous by reducing the risk of light reflected by the first reflector being hindered by the second reflector.

According to a preferred embodiment, the at least two reflector elements comprise a first reflector element at a first obtuse tangential angle with respect to the mounting substrate, a second reflector element at a lower height than the first reflector element and at a second obtuse tangential angle with respect to the mounting substrate, and a third reflector element at a lower height than the second reflector element and at a third obtuse tangential angle with respect to the mounting substrate. Preferably, the third angle is higher than the second angle, and the second angle is higher than the first angle. Preferably the difference between the third and first tangential angle is at least 1%, more preferably at least 5%, e.g. between 1 and 10%.

According to an exemplary embodiment, the at least two reflector elements comprise a first curved reflector element and a second curved reflector element at a lower height than the first reflector element, wherein the second reflector element is curved more downward towards the mounting substrate than the first reflector element. According to a further embodiment, the at least two reflector elements comprise a first curved reflector element, a second curved reflector element at a lower height than the first reflector element, and a third curved reflector element at a lower height than the second reflector element, wherein the third reflector element is curved more downward towards the mounting substrate than the second reflector element and the second reflector element is curved more downward towards the mounting substrate than the first reflector element.

Preferably, a radius of curvature of the second reflector element is higher than a radius of curvature of the first reflector element. In the embodiment with the third reflector element, preferably a radius of curvature of the third reflector element is higher than a radius of curvature of the second reflector element. When using curved reflector elements, preferably, an upper surface of each reflector element is a convex surface, and a lower surface of each reflector element may be a concave surface. According to a further embodiment, the at least two reflector elements comprise a first curved reflector element and a second flat reflector element.

In this manner, a light source located higher on the mounting substrate has its light projected further on the ground by the first reflector element than a light source located lower. The light distribution of the lighting apparatus on the ground is thus further tailored by the progressive degree of curvature of the at least two reflector elements.

According to an exemplary embodiment, the mounting substrate is vertical.

In this way, the lighting apparatus is a smaller hindrance along one dimension which improves the lighting apparatus usability in space-restricted environments.

According to a preferred embodiment, one or each of the at least two reflector elements is made of metallized silicone, plastic, metallized plastic, or metal, preferably aluminum.

In a particular embodiment, a coating may be applied on the reflector element, e.g. a white reflective coating.

In this manner, the reflectivity of the at least two reflector elements is increased.

A reflective surface of a reflector element of the at least two reflector elements may have different optical properties than an opposite surface thereof. The reflective surface of the reflector element facing the corresponding light source may be specular, diffusive, and/or white. The opposite surface thereof may be at least partly diffusive and/or black.

In an alternative exemplary embodiment, the opposite surface of the reflector element may comprise a first portion adjacent to the first edge which is specular, diffusive and/or white, and a second portion adjacent to the second edge which is diffusive and/or black. In this way, light directly emitted from a lens element and impinging upon the first portion of the opposite surface of the reflector element below may be reflected towards a surface to be illuminated or towards the reflective surface of the corresponding reflector element; and light directly emitted from the lens element and impinging upon the second portion of the opposite surface of the reflector element below may be partly absorbed or diffused.

According to an exemplary embodiment, one or each of the at least two reflector element comprises a reflective coating provided to one or each lens element of the plurality of lens elements. The reflective coating may be e.g. a silver oxide or aluminum coating. The reflective coating may be applied e.g. by physical vapor deposition or by chemical vapor deposition.

In this way, the reflector elements are integrated to the lens elements, which allows the lighting apparatus to be more compact and/or to increase the density of light sources.

According to a preferred embodiment, one or each of the plurality of lens elements has a first surface and a second surface located on opposite sides thereof. Preferably, the first surface is a convex surface and the second surface is a concave surface. In alternative embodiments, the first surface may be a flat surface and the second surface a concave surface, the first surface may be a convex surface and the second surface a flat surface. The second surface extends over the corresponding light source.

In this manner, the light source placed at the second surface side of the lens element has its emitted light being spread. The shape of the lens element and position of the lens element with respect to the light source will influence the distribution and intensity profile of light. More in particular, the light source associated with its corresponding lens element will have light emitted in one main light direction, said light direction being the direction of maximum light intensity. In an embodiment according to the present invention, the convex and concave surfaces are designed such that said one principal light direction is below the second edge of the reflector element corresponding to the light source and does not impinge the reflector element corresponding to a below-positioned light source.

According to an exemplary embodiment, one or each of the plurality of lens elements comprises a free form lens element.

A lens element may be free form in the sense that it is not rotation symmetrical. In this way, one or each of the plurality of lens elements can be designed to further be suited to the combination of the angle of the mounting substrate and of the at least two reflector elements, in order to fulfill the desired usage of the lighting apparatus in its installed position.

According to a preferred embodiment, at least one of the first surface or second surface of one or each of the plurality of lens elements comprises a first curved surface and a second curved surface, said first curved surface being connected to said second curved surface through a connecting surface or line comprising a saddle point or discontinuity.

In this manner, the light source associated with the lens element has at least two light directions, said light directions being directions of light intensity local maxima. Having multiple light directions enables to concentrate a part of the light emitted towards specific portions of a corresponding reflector element for an improved illumination of the lighting apparatus.

In an embodiment according to the present invention, one or each of the plurality of lens elements comprises two convex surfaces, preferably two outwardly bulging surfaces, such that there is a first and a second light direction. The first direction is above a substantially horizontal level to impinge the corresponding reflector element on a specific portion of said reflector element so that the light is reflected towards a desired surface of the ground to be illuminated. The second direction is below the second edge of the corresponding reflector element and does not impinge the reflector element corresponding to a below-positioned light source so that the light is projected towards a desired surface of the ground to be illuminated.

In an exemplary embodiment, the first surface of one or each of the plurality of lens elements comprises a first outwardly bulging surface, a second outwardly bulging surface, and an external connecting surface or line connecting said first and second outwardly bulging surfaces. Additionally or alternatively, the second surface of one or each of the plurality of lens elements comprises a first outwardly bulging surface, a second outwardly bulging surface, and an internal connecting surface or line connecting said first and second outwardly bulging surfaces.

In an exemplary embodiment, both first and second surfaces of one or each of the plurality of lens elements comprise a first and second outwardly bulging surfaces, and internal and external connecting surfaces or lines connecting said first and second outwardly bulging surfaces internally and externally, respectively.

In an advantageous embodiment, at least one of the first surface or second surface of one or each of the plurality of lens elements comprises a third curved surface, preferably an outwardly bulging surface, said third curved surface being connected to said second curved surface through a connecting surface or line comprising a saddle point or discontinuity. The light source associated with the third curved surface may emit light in a light direction towards an opposite surface portion of a reflector element below. The opposite surface portion of the reflector element below may be reflective and reflect impinging light towards the surface to be illuminated and/or towards the reflective surface of the corresponding reflector element.

According to an exemplary embodiment, the first curved surface is located higher than the second curved surface as seen in a vertical direction, and the saddle point or discontinuity is located below the corresponding light source as seen in a vertical direction.

In an advantageous embodiment, the lens element has a symmetry axis along a vertical direction. In an alternative embodiment, the lens element is asymmetric with respect to a vertical direction when mounted to promote emission of light towards a specific side of the lens element.

In this way, a large portion of light emitted by the light source may be guided by the portion of the corresponding lens element comprising the first curved surface. The first curved surface being closer to the surface of the corresponding reflector element as seen in a vertical direction, more light can be guided towards the reflective surface of the reflector element. By designing jointly the lens element optical properties and the reflector element optical properties, redirection of light towards the surface to be illuminated for a desired light distribution and glare suppression may be optimized.

According to an exemplary embodiment, the saddle point or discontinuity may be comprised by the first and/or second surface of one or each of the plurality of lens elements. In another embodiment, the saddle point or discontinuity may be located above the corresponding light source as seen in a vertical direction and may be comprised by the second surface of the plurality of lens elements.

According to a preferred embodiment, one or each of the plurality of lens elements is configured for guiding at least 50%, preferably at least 55%, more preferably at least 60%, most preferably at least 65%, of the light emitted by the corresponding light source towards the reflective surface of the corresponding reflector element.

In this manner, the majority of light composing the light distribution of the apparatus is reflected light and the reflector elements are predominant in shaping the light distribution. Glare is reduced by increasing the amount of reflected light in the light distribution, especially since the reflected light is light emitted above the location of the light source as seen in a vertical direction.

According to an exemplary embodiment, one or each of the plurality of lens elements is configured for guiding at most 45%, preferably at most 40%, more preferably at most 35%, most preferably at most 30%, of the light emitted by the corresponding light source below the second edge of the corresponding reflector element.

In this way, glare is reduced by reducing the amount of direct light in the light distribution.

According to a preferred embodiment, the corresponding reflector element is configured for guiding as reflected light at least 55%, preferably at least 60%, more preferably at least 65%, most preferably at least 70% of the light emitted by the corresponding light source towards a surface to be illuminated.

A portion of the light reflected may originate directly from the corresponding lens element.

Another portion of the light reflected may be reflected by a reflector element below the corresponding reflector element.

The corresponding lens element and reflector element may be designed jointly in order to obtain a desired light distribution. Additionally, the corresponding lens element and reflector element may be designed while taking into account one or more neighboring reflector elements, as well as light emitted from the lens element and reflecting on surfaces of the one or more neighboring reflector elements. In this manner, the portion of the light distribution being reflected may be further increased, and consequently the glare further limited.

According to an exemplary embodiment, the apparatus further comprises:

- another plurality of light sources mounted on a lower or vertical surface of the mounting substrate such that another at least two light sources of the another plurality of light sources are at a different height, wherein the plurality of light sources and the another plurality of light sources are at a different height;
- a first light-shaping module;
- a second light-shaping module;
- wherein the first light-shaping module comprises;
  - the plurality of lens elements; and
  - the at least two reflector elements;
- wherein the second light-shaping module comprises:
  - another plurality of lens elements provided to the mounting substrate such that each of the another plurality of light sources is provided with a corresponding lens element;

another at least two reflector elements provided to the another at least two light sources, such that each of the another at least two reflector elements has a reflective surface facing the mounting substrate;

wherein each of the another at least two reflector elements extends between a first edge and a second edge;

wherein each of the another at least two reflector elements first edge is being located above a corresponding light source of the another at least two light sources as seen in a vertical direction;

wherein each of the another at least two reflector elements second edge is being located below a corresponding light source of the another at least two light sources as seen in a vertical direction.

In this way, the optical properties of a specific light-shaping module may easily be replicated across the area of the lighting apparatus. The optical properties of the first and second light-shaping modules may be similar. Alternatively, light-shaping modules with different optical properties may be mounted across the area of the lighting apparatus to tailor the light distribution of each light-shaping module with respect to their height. The skilled person will understand that the hereinabove described technical considerations and advantages related to the features for luminaire apparatus embodiments, and in particular related to the lens elements and the reflector elements, also apply for the above described first and second light-shaping modules embodiments, mutatis mutandis.

According to a preferred embodiment, a first distance h1 between adjacent light sources at different heights associated with the first light-shaping module or second light-shaping module is lower than a second distance h2 between a light source associated with the first light-shaping module and another light source associated with the second light-shaping module at a different height.

In this manner, potentially negative influence of the first and second light-shaping modules with respect to each other is mitigated.

The skilled person will understand that the hereinabove described technical considerations and advantages for luminaire apparatus embodiments also apply to the below described corresponding light pole module and lamp post embodiments, mutatis mutandis.

According to an exemplary embodiment, there is provided a light pole module. The light pole module comprises:

a lighting apparatus according to any one of the previous embodiments;

a housing, said housing comprising an at least partially transparent or translucent sidewall facing the plurality of light sources, and said housing further comprising a lower end portion configured for being attached to a support pole.

Also the invention relates to a lamp post comprising a support pole, a light pole module, and optionally one or more additional pole modules such as lighting pole modules, signal pole modules, functional pole modules, . . . The pole modules are arranged one above the other above the support pole.

According to an exemplary embodiment the plurality of pole modules are pole modules as disclosed in EP 3 076 073 B1 which is included herein by reference. By using pole module connectors as disclosed in EP 3 076 073 B1 with two connector portions which can be clamped around round end parts of the pole modules, a pole module can be rotated around the axial direction of the support pole in the desired position and then fixed by the connector portions.

Examples of functional circuitry which may be included in a functional pole module are any one or more of the following:

an antenna configured for receiving and emitting cellular data, e.g. for 4G or 5G cellular connection;

power management circuitry comprising e.g. one or more of: a power meter, a fuse, a line protection, a circuit breaker, an electrical connection for multiple power lines, a clock, an astroclock, a power supply module, an PLC, a computer, a communication module, display circuitry, etc.;

telecommunication circuitry which can comprise at least one of: an optical fiber connection, a fiber to copper interface, a fiber patch panel, a modem, a router, a switch, a patch panel, a network video recorder (NVR), a computer;

audio system management circuitry which can comprise at least one of: an amplifier, a transformer, a media player (connected to network or not), electrical connections for multiple loudspeaker lines, a computer;

WiFi circuitry, wherein an antenna for receiving WiFi signals may be integrated either in the functional module or in a separate antenna module as in the exemplary embodiment of the lamp post with a base station module;

charger circuitry, e.g. phone charger circuitry or vehicle charger circuitry;

an environmental sensor such as a microphone, or a detector of $CO_2$, $NO_x$, smoke, etc., and the associated circuitry;

a human interface device (HID) and the associated circuitry, e.g. a camera, a loudspeaker, a button, etc.;

an air quality sensor;

a camera, a video recorder, an image sensor.

According to a preferred embodiment, there is provided a lamp post. The lamp post comprises a lighting apparatus according to any one of the previous embodiments.

BRIEF DESCRIPTION OF THE FIGURES

This and other aspects of the present invention will now be described in more detail, with reference to the appended drawings showing a currently preferred embodiment of the invention. Like numbers refer to like features throughout the drawings.

DESCRIPTION OF EMBODIMENTS

Figure 1A:
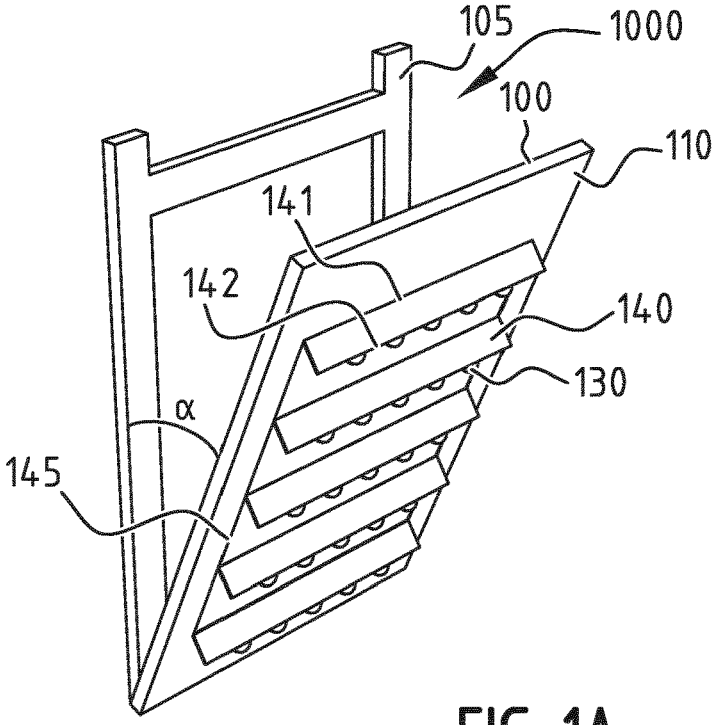
FIGS. 1A and 1B show a perspective view and a cut side view, respectively, of an exemplary embodiment of a lighting apparatus according to the invention.
Figure 1B:
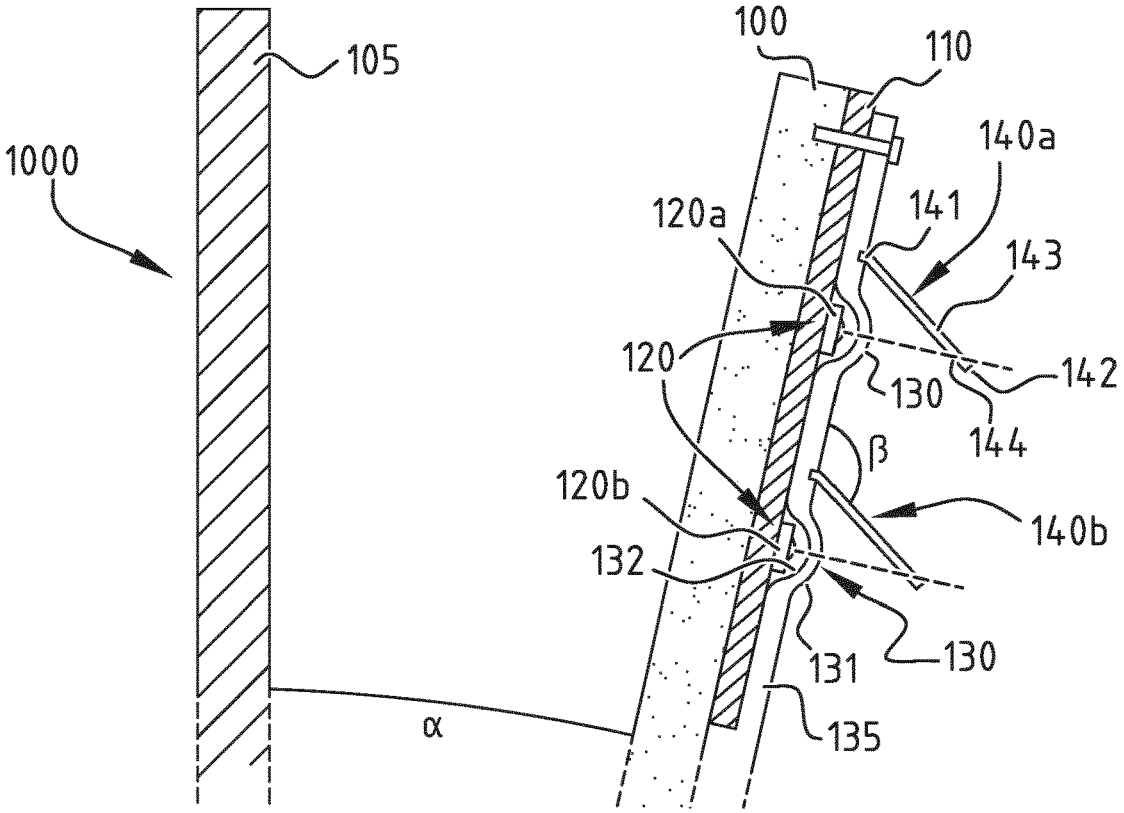

FIGS. 1A and 1B shows a perspective view and a cut side view, respectively, of an exemplary embodiment of a lighting apparatus according to the present invention. The lighting apparatus 1000 comprises a mounting substrate 110, a plurality of light sources 120, a plurality of lens elements 130, and at least two reflector elements 140.

The mounting substrate 110 is being arranged in the lighting apparatus 1000 at an angle α below 45° with respect to a vertical direction. The mounting substrate 110 is fixed to a bracket 105 in the exemplary embodiment of FIG. 1 but may be provided in any suitable manner in the lighting apparatus 1000. In another embodiment, the mounting substrate 110 may be arranged on at least one angled support fixture part of a housing of the lighting apparatus 1000, said support fixture being at an angle α below 45° with respect to a vertical direction. In still another embodiment, the mounting substrate 110 may be mounted in a substantially vertical position.

In the exemplary embodiment shown in FIGS. 1A and 1B, the mounting substrate 110 is provided on a support 100 shaped as a rectangular plate. However the skilled person will understand that this particular shape is not limitative as long as the support 100 is sufficiently rigid to perform its function. The support 100 is made of a thermally conductive material, preferably from a metal, more preferably from aluminum. The mounting substrate 110 may be a printed circuit board (PCB) with the plurality of light sources 120 disposed thereon. The mounting substrate 110 is provided to the support 100 such that the support 100 and the mounting substrate 110 are in thermal contact.

The plurality of light sources 120 may be mounted on a lower surface of the mounting substrate 100 such that at least two light sources 120*a*, 120*b* of the plurality of light sources 120 are at a different height. The plurality of light sources 120 may be arranged without a determined pattern or may describe an array, e.g. an array of a plurality of rows by a plurality of columns, such as a five by five array as shown in FIG. 1A. The size of the array may be designed depending on the intended use of the lighting apparatus 1000, e.g. walk path illumination, large road, park, etc. The plurality of light sources 120 may comprise a plurality of LEDs. Further, each light source 120 may comprise a plurality of LEDs, e.g. a multi-chip of LEDs. The plurality of light sources 120 could also be light sources other than LEDs, e.g. halogen, incandescent, or fluorescent lamps. The surface onto which the plurality of light sources 120 is mounted can be made reflective or white to improve the light emission.

The plurality of lens elements 130 is provided to the mounting substrate 110 such that each of the plurality of light sources 120 is provided with a corresponding lens element 130. In the exemplary embodiment shown in FIGS. 1A and 1B, the lens elements 130 are similar in size and shape and there is one lens element 130 for each light source 120. In another exemplary embodiment, the lens elements 130 may be different from each other. In other embodiments, there may be provided a plurality of light sources 120 below each lens element 130.

The lens element 130 may be free form in the sense that it is not rotation symmetrical. In the illustrated embodiment of FIGS. 1A and 1B lens elements 130 have a symmetry axis along a vertical direction of the lens elements 130. The lens element 130 comprises a first surface 131 and a second surface 132 located on opposite sides. The second surface 132 faces the plurality of light sources 120. The first surface 131 is a convex surface. The second surface 132 is a concave surface, but may also be a planar surface. As such, the lens element 130 corresponding to the light source 120 may be diffusing light from the corresponding light source in at least one principal lighting direction, said lighting direction being a direction of maximum lighting intensity. In another embodiment, the first surface 131 may comprise two convex surfaces and may be diffusing light from the corresponding light source 120 in at least two principal lighting directions, said at least two lighting directions being directions of lighting intensity local maxima.

The plurality of lens elements 130 may have a maximum length different from a maximum width. The lens elements 130 are in a transparent or translucent material. They may be in optical grade silicone, glass, poly(methyl methacrylate) (PMMA), polycarbonate (PC), or polyethylene terephthalate (PET).

The plurality of lens elements 130 shown in FIGS. 1A and 1B may be part of an integrally formed lens plate 135. In other words the lens elements 130 may be interconnected so as to form a lens plate 135 comprising the plurality of lens elements 130. The lens plate 135 may be formed, e.g. by injection molding, casting, transfer molding, or in another appropriate manner. Alternatively, the lens elements 130 may be separately formed, e.g. by any one of the above mentioned techniques.

The lighting apparatus 1000 may further comprise at least two reflector elements 140*a*, 140*b* provided to the at least two light sources 120*a*, 120*b*. Each of the at least two reflector elements 140*a*, 140*b* has a first edge 141 being located above a corresponding light source 120*a*, 120*b* as seen in a vertical direction. Each of the at least two reflector elements 140*a*, 140*b* has a second edge 142 being located below a corresponding light source 120*a*, 120*b* as seen in a vertical direction. The reflector element 140 comprises a first surface 143 and a second surface 144 located on opposite sides. The second surface 144 faces a row of light sources 120. The first and the second surfaces 143, 144 may be planar surfaces. In other embodiments, the first and second surfaces 143, 144 may be curved in a longitudinal or lateral direction, or may comprise several planar and/or curved surfaces.

The reflector elements 140*a*, 140*b* may be made of any suitable material having reflective surface, such as metallized silicone, plastic, metallized plastic, or metal, preferably aluminum. Optionally a coating may be applied on the first surface 143 and/or second surface 144 of the reflector elements 140*a*, 140*b*. The second surface 144 of the reflector element 140*a*, 140*b* facing the corresponding light source 120*a*, 120*b* may have different optical properties than the opposite first surface 143 thereof. The second surface 144 of the reflector element 140*a*, 140*b* facing the corresponding light source 120 may be specular, diffusive, and/or white. The opposite first surface 143 thereof may be at least partly diffusive and/or black.

In an alternative exemplary embodiment, the opposite first surface 143 of the reflector element 140*b* may comprise a first portion adjacent to the first edge 141 which is specular, diffusive and/or white, and a second portion adjacent to the second edge 142 which is diffusive and/or black. In this way, light directly emitted from a lens element 130 and impinging upon the first portion of a first surface 143 of a reflector element 140*b* below may be reflected towards a surface to be illuminated or towards the second surface 144 of the corresponding reflector element 140*a*; and light directly emitted from the lens element 130 associated with the corresponding reflector element 140*a* and impinging upon the second portion of the first surface 143 of the reflector element 140*b* below may be partly absorbed or diffused.

The reflector elements 140 may be mounted such that they are not in contact with the mounting substrate 110 onto which metallic connecting traces are provided. In the exemplary embodiment of FIGS. 1A and 1B, the reflector elements 140 are mounted on the lens plate 135 by clipping. The clipping means may be designed such that the reflector elements 140 are partially, preferably fully, supported by the lens plate 135. Additionally, the clipping means may be designed such that reflector elements 140 comprising metal are electrically insulated from the mounting substrate 110, e.g. by providing a predetermined material thickness between the clipped base of a reflector element 140 and a conducting surface of the mounting substrate 110.

In another embodiment, the reflector elements 140 may be integrated in a frame 145 extending over the plurality of light sources 120. In an exemplary embodiment the frame 145 and the at least two reflector elements 145 may be in a different material, e.g. a plastic frame integrating metallic reflector elements. In another exemplary embodiment, the frame 145 and the at least two reflector elements 140 may be made of the same material, e.g. both frame and the at least two reflector elements are metallic. In a particular exemplary embodiment, the frame 145 and the at least two reflector elements 140 are integrally formed. In another particular exemplary embodiment, the at least two reflector elements 140 may be removably integrated to the frame 145 such that maintenance and interchangeability of the at least two reflector elements are facilitated. In other embodiments, the frame 145 may be mounted on the lens plate 135, or to the support 100 via non-conductive fixing means, e.g. plastic rivets, or to a frame fixture extending on either sides of the mounting substrate 110.

Each of the reflector elements 140 may correspond to one light source 120 or to at least two adjacent light sources 120, e.g. to one row of adjacent light sources 120 in the embodiment of FIG. 1A. Each of the reflector elements 140 is mounted at an obtuse tangential angle β with respect to the mounting substrate 110 at the first edge 141 of each of the reflector elements. The obtuse tangential angle β may be comprised between 90° and 170°, preferably between 100° and 160°, more preferably between 110° and 150° with respect to the mounting substrate 110.

Figure 2:
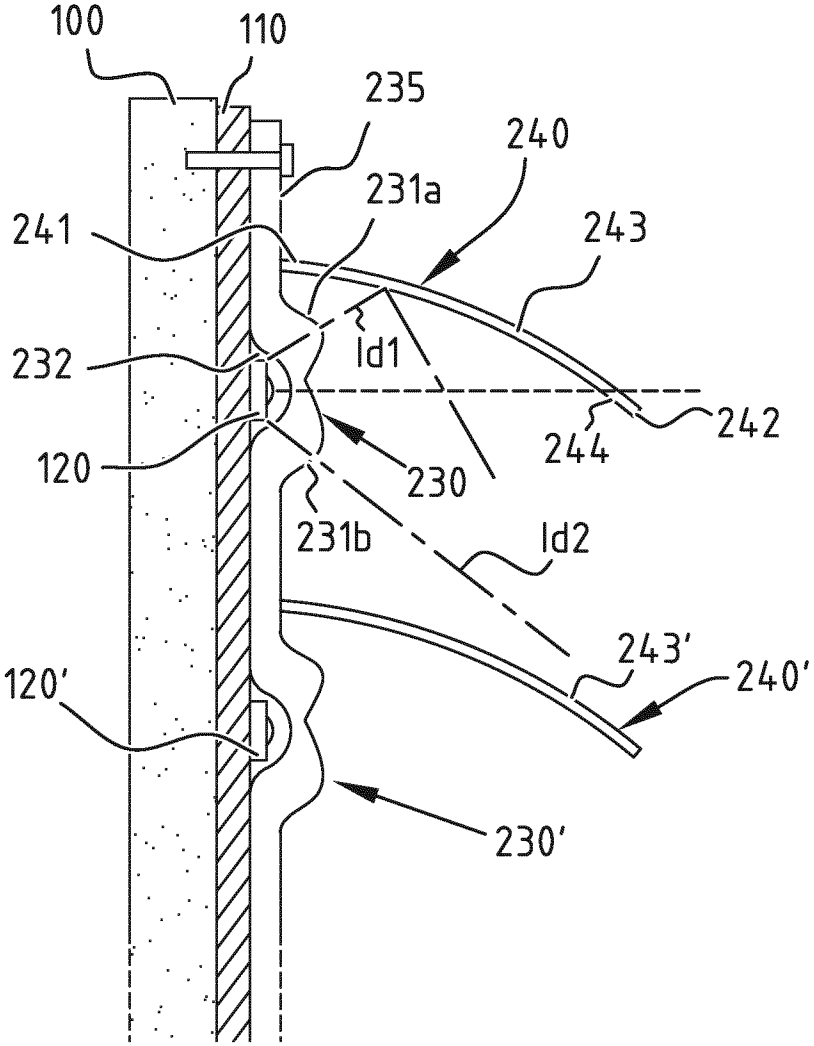
FIG. 2 shows a cut side view of another exemplary embodiment of a lighting apparatus according to the invention.

The function of the reflector elements 140 is to redirect the light emitted by the plurality of light sources 120 and diffused by the corresponding plurality of lens elements 130. By redirecting the light substantially downward thanks to the angle α at which the mounting substrate 110 is provided and thanks to the tangential angle β at which the reflector elements 140 are mounted at, a suitable lighting pattern can be defined on a surface below the lighting apparatus 1000. Further, reflector elements 140 may be designed associated with lens elements 130 to improve the efficiency of the light redirection applied by the reflector elements 140. In the embodiment of FIG. 2, a lens element 230 having two lighting directions is shown taking advantage of the configuration using reflector elements 240. Additionally, with the lighting apparatus of the present invention light emitted substantially horizontally or above is not perceived by a passer-by, thus effectively reducing and/or eliminating glaring problems of vertically-mounted or angled lighting apparatus.

FIG. 2 shows a cut side view of another exemplary embodiment of a lighting apparatus according to the present invention. The lighting apparatus 1000 comprises a mounting substrate 110, a plurality of light sources 120, 120', a plurality of lens elements 230, 230' and a plurality of reflector elements 240, 240'.

The mounting substrate 110 is provided to a substantially vertical support 100. The plurality of light sources is mounted on the mounting substrate 110 such that at least two light sources 120, 120' of the plurality of light sources are at a different height. The plurality of lens elements 230, 230' is provided to the mounting substrate 110 such that each of the plurality of light sources 120, 120' is provided with a corresponding lens element 230, 230'. In the exemplary embodiment shown in FIG. 2, the lens elements 230, 230' are similar in size and shape and there is one lens element 230, 230' for each light source 120, 120'. In other embodiments, the lens elements 230, 230' can be different from each other.

The lens element 230 comprises a first surface and a second surface 232 located on opposite sides. The second surface 232 is a concave surface facing the corresponding light source 120. The first surface comprises two convex surfaces 231*a*, 231*b* diffusing light from the corresponding light source 120 in two principal lighting directions ld1 and ld2. The first lighting direction ld1 corresponding to the first convex surface 231*a* is directed towards the second surface 244 of the corresponding reflector element 240, such that light emitted by the light source 120 and diffused through the first convex surface 231*a* may be reflected downwards. The second lighting direction ld2 corresponding to the second convex surface 231*b* is directed below the second edge 242 of the corresponding reflector element 240. Alternatively, there may be a further convex surface associated with a further lighting direction directed towards the first surface 243' of the reflector element 240' corresponding to the light source 120' at a lower height.

The reflector elements 240, 240' may be curved as seen in a vertical direction and have a first surface 243 and a second surface 244 located on opposite sides thereof. The first surface 243 may be a convex surface, and the second surface 244 may be a concave surface. Each of the reflector elements 240, 240' may correspond to an entire row of light sources 120.

According to an exemplary embodiment, the second reflector element 240' is curved more downward towards the mounting substrate 110 than the first reflector element 240. Preferably, a radius of curvature of the second reflector element 240' is higher than a radius of curvature of the first reflector element 240.

Figure 3:
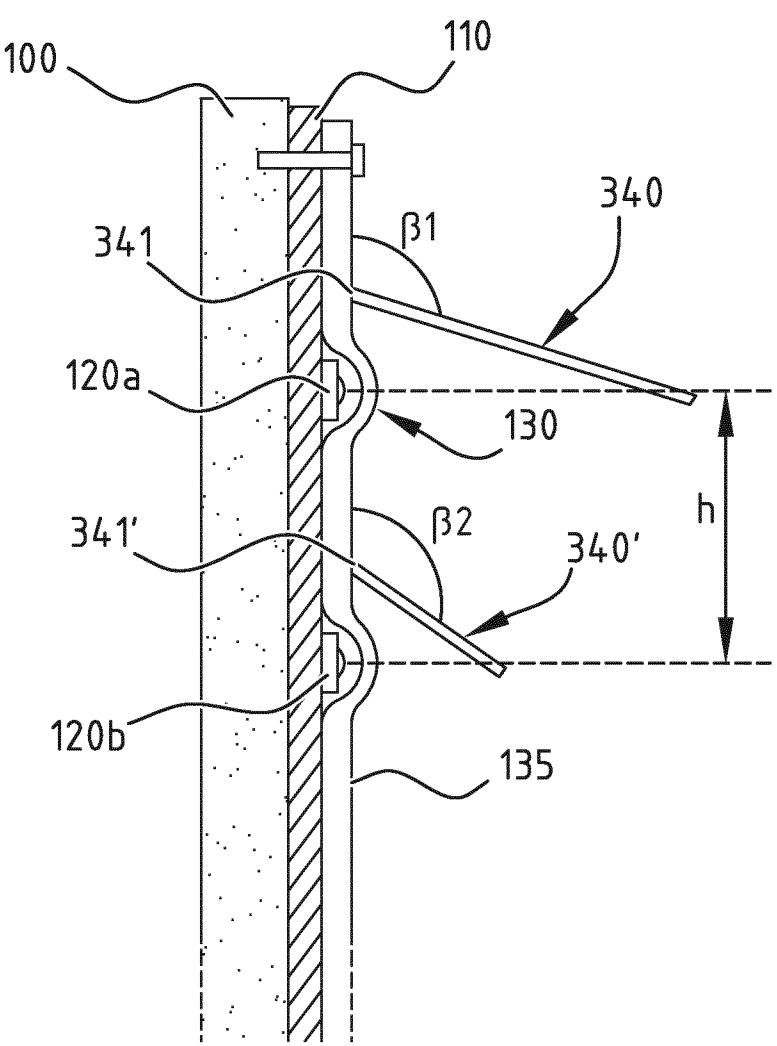
FIG. 3 shows a cut side view of another exemplary embodiment of a lighting apparatus according to the invention.

FIG. 3 shows a cut side view of another exemplary embodiment of a lighting apparatus according to the present invention. The lighting apparatus 1000 comprises a mounting substrate 110, a plurality of light sources 120, a plurality of lens elements 130, and at least two reflector elements 340, 340'.

The mounting substrate 110 is provided to a substantially vertical support 100. The plurality of light sources 120 is mounted on the mounting substrate 110 such that at least two light sources 120*a*, 120*b* of the plurality of light sources 120 are at a different height. The plurality of lens elements 130 is provided to the mounting substrate 110 such that each of the plurality of light sources 120*a*, 120*b* is provided with a corresponding lens element 130. In the exemplary embodiment shown in FIG. 3, the lens elements 130 are similar in size and shape and there is one lens element 130 for each light source 120*a*, 120*b*. In other embodiments, the lens elements 230, 230' can be different from each other. The lens element 130 comprises a first surface and a second surface located on opposite sides. The second surface faces the plurality of light sources 120. The first surface is a convex surface. The second surface is a concave surface.

The reflector elements 340, 340' may have a first and a second planar surface located on opposite sides thereof. Each of the reflector elements 340, 340' may correspond to a row of the plurality of light sources 120 located at different heights. The reflector elements 340, 340' may comprise a first reflector element 340 whose first edge 341 is located above a first edge 341' of a second reflector element 340'. The first obtuse tangential angle β1 with respect to the mounting substrate 110 at the first edge 341 of the first reflector element is lower than the second obtuse tangential angle β2 with respect to the mounting substrate 110 at the first edge 341' of the second reflector element. Thus the diffused light of the lighting apparatus 1000 emitted from light sources 120*a*, 120*b* located at different heights as seen in a vertical direction may have less overlapping light distributions.

In another exemplary embodiment, at least two lens elements 130 corresponding to at least two light sources 120*a*, 120*b* at different heights may be integrated in a lens plate 135. Reflector elements 340, 340' with increasing obtuse tangential angles with respect to the height of the corresponding light source 120*a*, 120*b* may be provided to said lens plate 135. The lighting apparatus 1000 may comprise a plurality of said lens plates 135 as seen in a vertical direction with similar reflector elements 340, 340' having increasing obtuse tangential angles. The at least two lens elements 130 and the corresponding at least two reflector elements 340, 340' with increasing obtuse tangential angles may be comprised in a light-shaping module as further described with respect to FIG. 8.

The distance h between adjacent light sources 120*a*, 120*b* at different heights associated with the same lens plate 135 may be lower than the distance between adjacent light sources 120*a*, 120*b* at different heights associated with two different lens plates 135.

In still another exemplary embodiment, the lighting apparatus 1000 may comprise a plurality of light sources 120 mounted at a plurality of different heights. The plurality of light sources 120 may be provided with a corresponding plurality of lens elements 130. The reflector elements 340, 340' corresponding to the plurality of light sources 120 may be provided such that the obtuse tangential angle of the reflector elements is increasing as the corresponding light source 120 is mounted lower on the mounting substrate 110.

Figure 4:
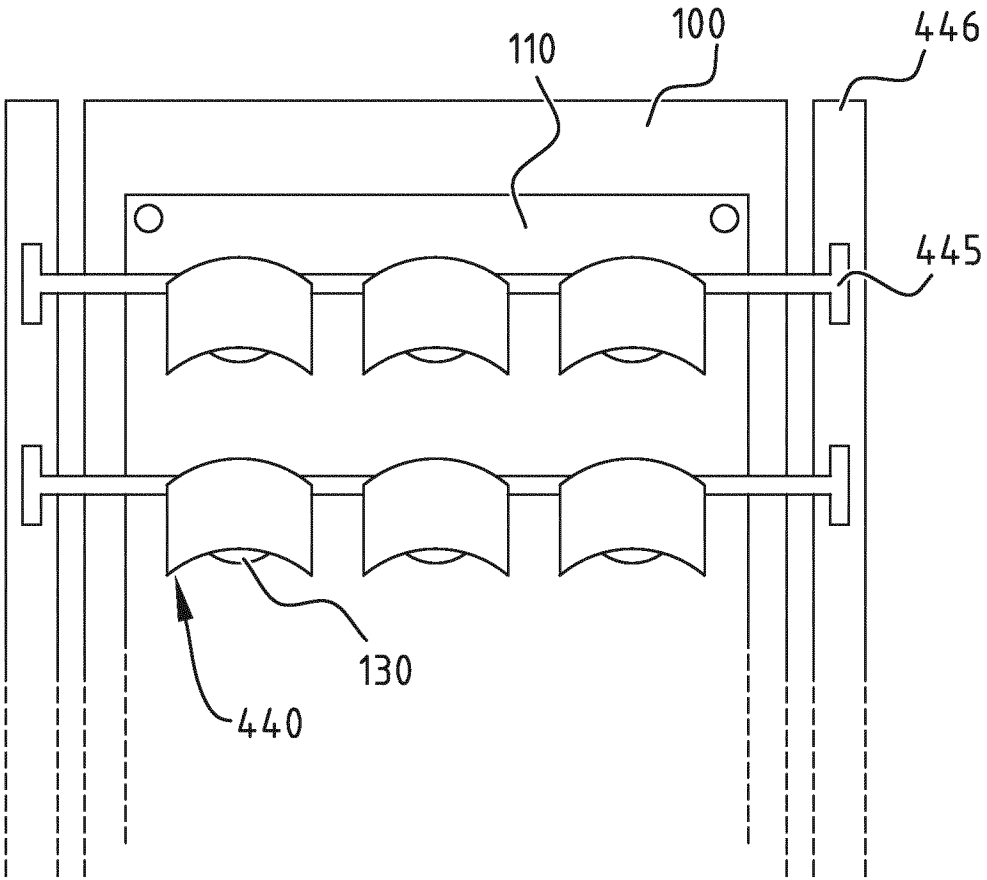
FIG. 4 illustrates schematically another exemplary embodiment of a lighting apparatus according to the invention.

FIG. 4 illustrates schematically another exemplary embodiment of a lighting apparatus according to the present invention. The lighting apparatus 1000 comprises a mounting substrate 110, a plurality of light sources 120, a plurality of lens elements 130, and a plurality of reflector elements 440.

Each of the reflector elements 440 may be provided to one light source 120. Each of the reflector elements 440 may be curved as seen longitudinally and may be integrated in a plurality of frame portions 445. Each of the frame portions 445 may be integrating a row of reflector elements 440 and may be mounted on a plurality of frame fixtures 446 extending on either sides of the mounting substrate 110. Alternatively each of the frame portion 445*s* may be integrating a column of reflector elements 440.

Figure 5:
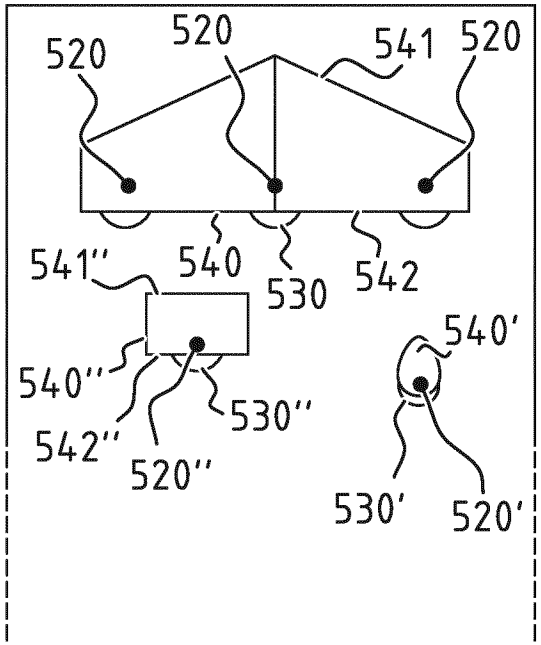
FIG. 5 illustrates schematically another exemplary embodiment of a lighting apparatus according to the invention.

FIG. 5 illustrates schematically another exemplary embodiment of a lighting apparatus according to the present invention. The lighting apparatus 1000 comprises a mounting substrate 110, a plurality of light sources 520, 520', 520", a plurality of lens elements 530, 530', 530", and a plurality of reflector elements 540, 540', 540". Note that the light sources 520, 520', 520" are shown schematically as dots, but are in fact hidden by the reflector elements 530, 530', 530".

The plurality of light sources 520, 520', 520" may be arranged without a predetermined pattern, as shown in the embodiment of FIG. 5 as a row of three light sources 520 and a first and a second single light source 520', 520" at two other different heights as seen in a vertical direction, the first independent light source 520' being located below the second independent light source 520" as seen in a vertical direction.

A first reflector element 540 may be provided to the row of light sources 520. The first reflector element 540 may be in a roof-shape with the highest point of the first edge 541 of the first reflector element 540 as seen in a vertical direction located above the central light source 520 of the row of light sources. The second edge 542 of the first reflector element may be extending over the row of light sources 520 such that the second edge 542 is being located below the corresponding light sources 520 of the row of light sources.

A second reflector element 540' may be provided to the first independent light source 520'. The second reflector element 540' may comprise a reflective coating provided to the lens element 530' corresponding to the first independent light source 520'.

A third reflector element 540" may be provided to the second independent light source 520". The third reflector element 540" may be provided at opposite left and right edges (extending between a first edge 541" and a second edge 542" of the third reflector element 540") with a first and a second lateral wall to limit the amount of light that diverges outwardly to the left and right sides of the light source 520".

Figure 6:
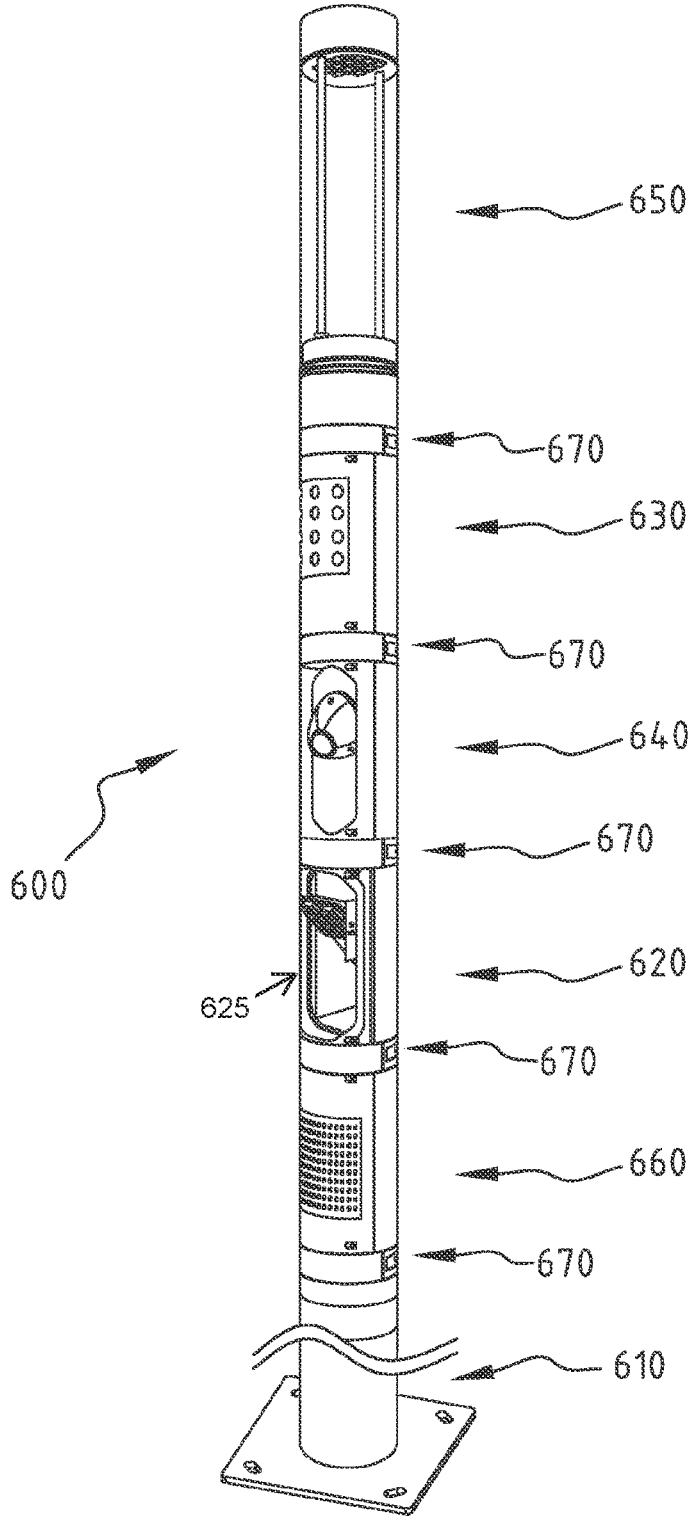
FIG. 6 illustrates schematically an exemplary embodiment of a lamp post of the invention.

FIG. 6 illustrates schematically an exemplary embodiment of a lamp post 600. The lamp post 600 comprises a support pole 610 and a plurality of pole modules 620, 630, 640, 650, 660 supported by the support pole 610. In the illustrated embodiment the plurality of pole modules comprises a light pole module 620 comprising a light source, a sensing pole module 630, a camera pole module 640, a further light pole module 650 and a loudspeaker pole module 660. The light pole module 620 comprises a housing 625 comprising an at least partially transparent or translucent sidewall facing the plurality of light sources, and said housing 625 further comprises a lower end portion configured for being attached to the support pole 610. The support pole 610 may be hollow, and may be provided with a removable door providing access to an inner part of said support pole 610. Further a signal pole module (not shown), such as a light ring module may be included in the lamp post 600.

It is noted that the term "supported" as in "the light pole module is supported by the support pole" does not imply that the light pole module needs to be directly fixed on the support pole; indeed, there may be intermediate pole modules or elements between the support pole 610 and the light pole module 620; the support pole 610 supports the light pole module 620, and any other functional pole modules.

Other examples of functionalities which may be included in one or more pole modules are any one or more of the following:

an antenna configured for receiving and emitting cellular data, e.g. for 4G or 5G cellular connection;

power management circuitry comprising e.g. one or more of: a power meter, a fuse, a line protection, a circuit breaker, an electrical connection for multiple power lines, a clock, an astroclock, a power supply module, an PLC, a computer, a communication module, display circuitry, etc.;

telecommunication circuitry which can comprise at least one of: an optical fibre connection, a fibre to copper interface, a fibre patch panel, a modem, a router, a switch, a patch panel, a network video recorder (NVR), a computer;

audio system management circuitry which can comprise at least one of: an amplifier, a transformer, a media player (connected to network or not), electrical connections for multiple loudspeaker lines, a computer;

WiFi circuitry;

charger circuitry, e.g. phone/computer/tablet charger circuitry or vehicle charger circuitry;

an environmental sensor such as a microphone, or a detector of $CO_2$, $NO_x$, smoke, etc., and the associated circuitry;

any human interface device (HID) and the associated circuitry.

The pole modules 620, 630, 640, 650, 660 may be arranged in any order one above the other, and may be connected to the support pole 610 and to each other in any suitable way, e.g. using pole module connectors 670 as described in EP 3 076 073 B1 in the name of the applicant which is included herein by reference. Two pole modules may be connected to each other using a pole module connector 700 comprising two connecting portions which can be clamped around round end parts of the pole modules. A pole module 620, 630, 640, 650, 660 can be rotated around the axial direction A of the support pole 610 in a desired position and then fixed by the connecting portions and a fixation means for coupling the two connecting portions to each other around round end parts of the pole modules to be connected.

Figure 7A:
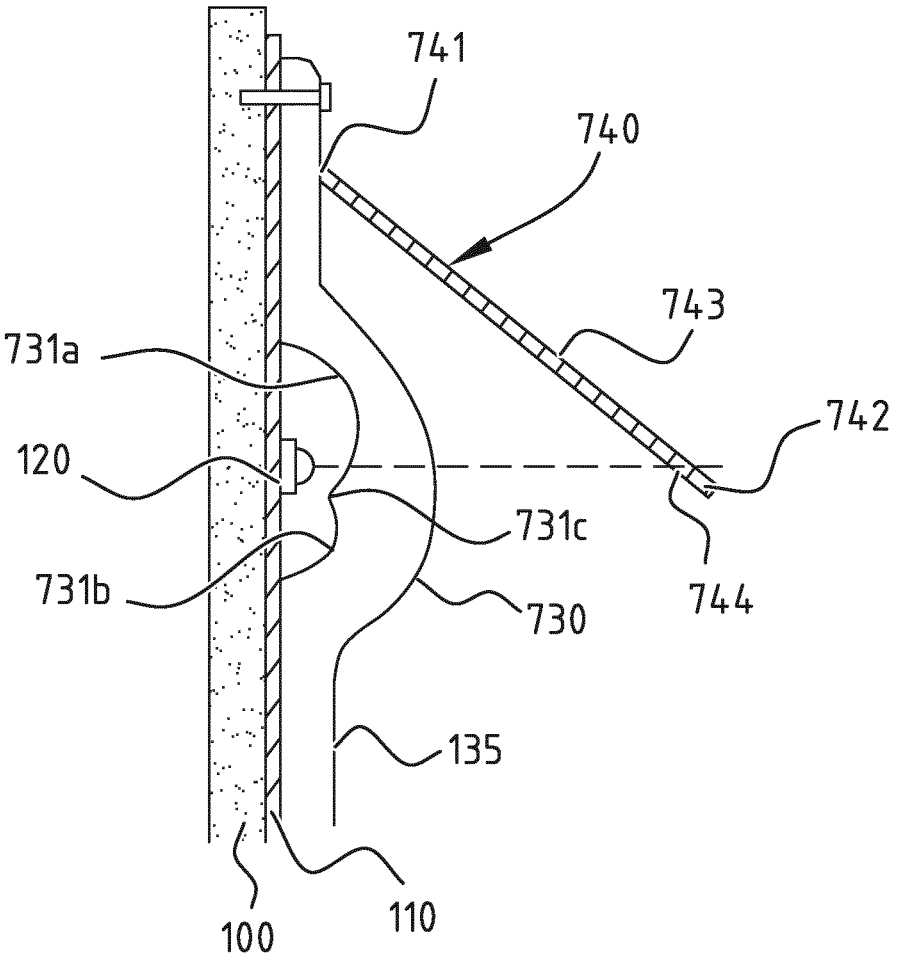
FIGS. 7A-7C show cross-section views of other exemplary embodiments of a lighting apparatus according to the invention.
Figure 7B:
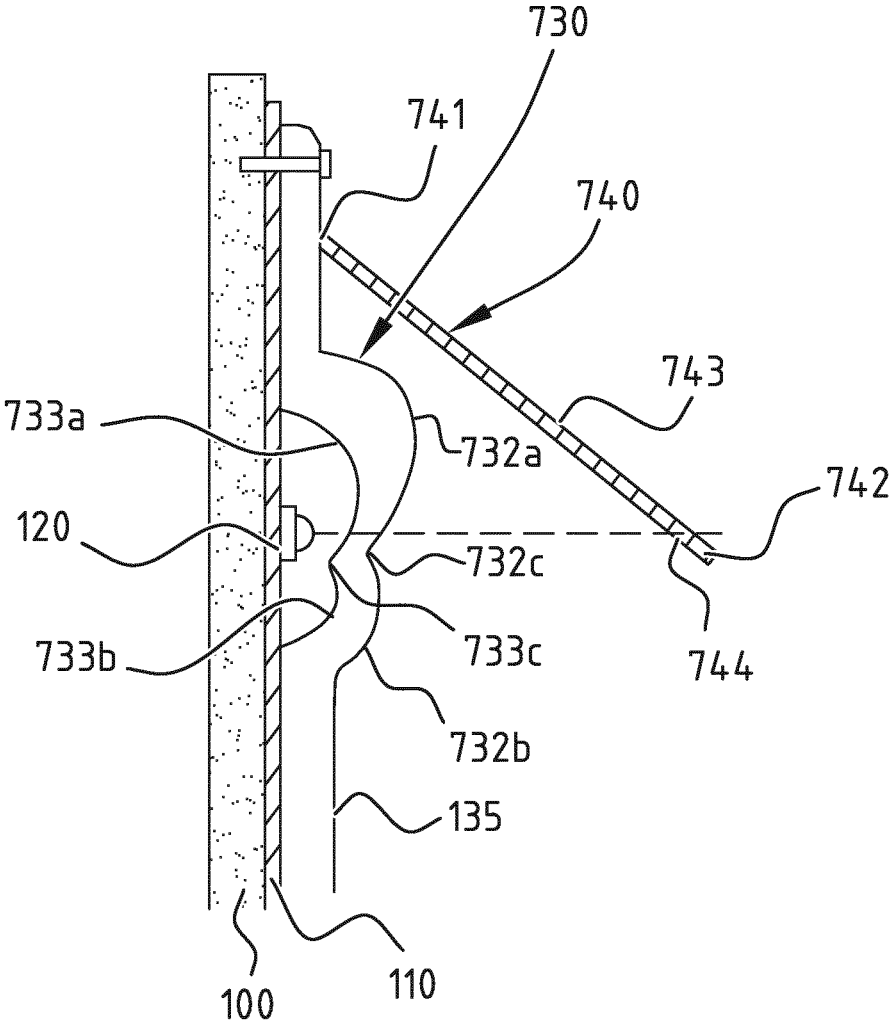
Figure 7C:
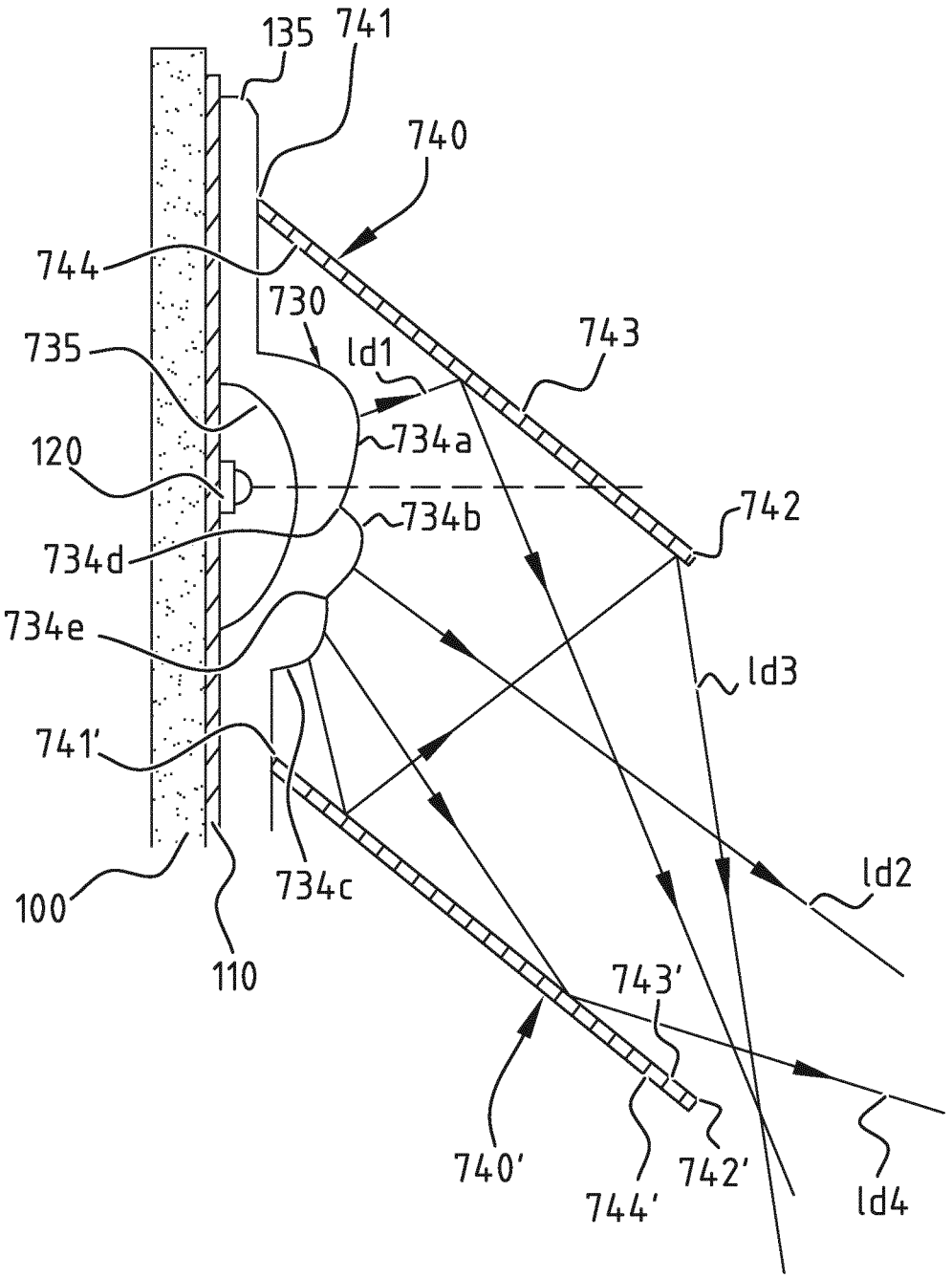

FIGS. 7A-7C show cross-section views of other exemplary embodiments of a lighting apparatus according to the present invention. The lighting apparatus 1000 comprises a mounting substrate 110, a plurality of light sources 120 (only one is shown), a plurality of lens elements 730 (only one is shown), and a plurality of reflector elements 740, 740'. The lens element 730 comprises an inner surface and an outer surface located on opposite sides.

In the embodiment of FIG. 7A, the inner surface of one or each of the plurality of lens elements 730 comprises a first outwardly bulging surface 731*a*, a second outwardly bulging surface 731*b*, and an internal connecting surface or line 731*c* connecting said first and second outwardly bulging surfaces 731*a*, 731*b*.

In the embodiment of FIG. 7B, both inner and outer surfaces of the plurality of lens elements comprise first 733*a*, 732*a* and second 733*b*, 732*b* outwardly bulging surfaces, and internal and external connecting surfaces or lines 733*c*, 732*c* connecting said first 733*a*, 732*a* and second 733*b*, 732*b* outwardly bulging surfaces internally and externally, respectively.

In the embodiments of FIGs. 7A-7B, the first outwardly bulging surface 731*a*, 732*a*, 733*a* may be located higher than the second outwardly bulging surface as seen in a vertical direction, and the saddle point or discontinuity 731*c*, 732*c*, 733*c* may be located below the corresponding light source 120 as seen in a vertical direction. In this way, a large portion of light emitted by the light source 120 may be guided by the portion of the corresponding lens element comprising the first outwardly bulging surface 731*a*, 732*a*, 733*a*. The first outwardly bulging surface 731*a*, 732*a*, 733*a* being closer to the reflective surface 744 of the corresponding reflector element 740 as seen in a vertical direction, more light can be guided towards the reflective surface 744 of the corresponding reflector element 740.

In advantageous embodiments, the saddle point or discontinuity located below the corresponding light source as seen in a vertical direction may be comprised by the inner and/or outer surface of the plurality of lens elements. In another embodiment, the saddle point or discontinuity may be located above the corresponding light source as seen in a vertical direction and may be comprised by the inner surface of the plurality of lens elements.

In the embodiment of FIG. 7C, the outer surface of the plurality of lens elements 730 comprises a third outwardly bulging surface 734*c*, said third outwardly bulging surface 734*c* being connected to the second outwardly bulging surface 734*b* through a connecting surface or line 734*e* comprising a saddle point or discontinuity. Additionally or alternatively, the inner surface 735 of the plurality of lens elements 730 comprises the third outwardly bulging surface. The light source 120 associated with the third outwardly bulging surface 734*c* may emit light in a light direction towards an upper surface 743' of a non-corresponding reflector element 740' mounted below. The upper surface 743' of the reflector element 740' below may be reflective and reflect impinging light towards the surface to be illuminated in the lighting direction ld4 and/or towards the lower surface 744 of the corresponding reflector element 740 in order to be reflected in the lighting direction ld3. The second outwardly bulging surface 734*b* may emit light essentially in a lighting direction ld2 between the corresponding reflector element 740 and the reflector element 740' below, such that it is directly impinging on the surface to be illuminated. The first outwardly bulging surface 734*a* may emit light essentially in a lighting direction ldl towards the reflective surface 744 of the corresponding reflector element 740 to be then reflected towards the surface to be illuminated. Depending on the design, the plurality of lens elements 730, and more particularly the first outwardly bulging surface 731*a*, 732*a*, 733*a*, 734*a*, may be configured for guiding at least 50%, preferably at least 55%, more preferably at least 60%, most preferably at least 65%, of the light emitted by the corresponding light source 120 towards the reflective surface of the corresponding reflector element 740. The plurality of lens elements 730, and more particularly the second outwardly bulging surface 731*b*, 732*b*, 733*b*, 734*b*, may also be configured for guiding at most 45%, preferably at most 40%, more preferably at most 35%, most preferably at most 30%, of the light emitted by the corresponding light source 120 below the second edge 742 of the corresponding reflector element 740. The plurality of lens element 730 and the plurality of reflector elements 740, 740' may also be designed jointly taking into account their relative positioning such that the plurality of lens elements 730 associated with the reflector elements 740, 740' are configured for guiding, as reflected light, at least 55%, preferably at least 60%, more preferably at least 65%, most preferably at least 70% of the light emitted by the corresponding light source 120 towards a surface to be illuminated.

In one embodiment, the upper surface 743' of the reflector element 740' below may be diffusive and/or black. In another embodiment, the upper surface 743' of the reflector element 740' below may comprise a first portion adjacent to the first edge 741' which is specular, diffusive and/or white, and a second portion adjacent to the second edge 742' which is diffusive and/or black. In this way, light directly emitted from the lens element 730 and impinging upon the first portion of the upper surface 743' of the reflector element 740' below may be reflected towards a surface to be illuminated or towards the lower reflective surface 743 of the corresponding reflector element 740; and light directly emitted from the lens element 730 and impinging upon the second portion of the upper surface 743' of the reflector element 740' below may be partly absorbed or diffused.

Figure 8:
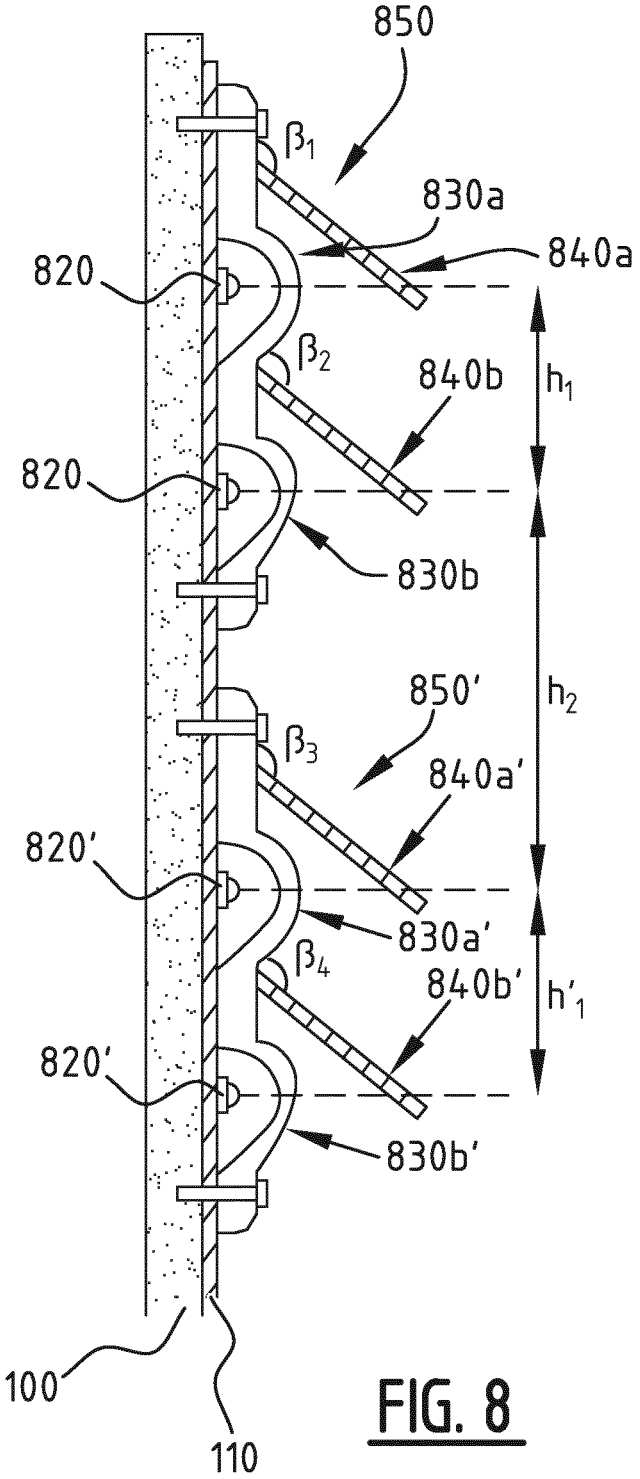
FIG. 8 illustrates a cross-section view of another exemplary embodiment of a lighting apparatus according to the invention.

FIG. 8 shows a cross-section view of another exemplary embodiment of a lighting apparatus according to the present invention. The lighting apparatus 1000 comprises a mounting substrate 110, a plurality of light sources 820, 820', a first light-shaping module 850, and a second light-shaping module 850'. Both first and second light-shaping modules 850, 850' comprise a plurality of lens elements 830*a*, 830*b*, 830*a*', 830*b*', and at least two reflector elements 840*a*, 840*b*, 840*a*', 840*b*' each, respectively.

The mounting substrate 110 is provided to a substantially vertical support 100. The plurality of light sources 820, 820' is mounted on the mounting substrate 110. There may be a plurality of light sources 820 associated to the first light-shaping module 850, and another plurality of light sources 820' associated to the second light-shaping module 850'. The plurality of light sources 820 and the another plurality of light sources 820' may be such that at least two light sources 820 of the plurality of light sources 820 are at a different height, and at least two light sources 820' of the another plurality of light sources 820' are at a different height. Moreover, the plurality of light sources 820 and the another plurality of light sources 820' may be at a different height.

For both first and second light-shaping modules 850, 850', the plurality of lens elements 830*a*, 830*b*, 830*a*', 830*b*' is provided to the mounting substrate 110 such that each of the plurality and the another plurality of light sources 820, 820' is provided with a corresponding lens element 830*a*, 830*b*, 830*a*', 830*b*'. In the exemplary embodiment shown in FIG. 8, the lens elements 830*a*, 830*b*, 830*a*', 830*b*' are similar in size and shape and there is one lens element 830*a*, 830*b*, 830*a*', 830*b*' for each light source 820, 820'.

The reflector elements 840*a*, 840*b*, 840*a*', 840*b*' may have a first and a second planar surface located on opposite sides thereof. Each of the reflector elements 840*a*, 840*b*, 840*a*', 840*b*' may correspond to a row of the plurality and the another plurality of light sources 820, 820' located at different heights. The reflector elements 840*a*, 840*b*, 840*a*', 840*b*' may be mounted at an obtuse tangential angle with respect to the mounting substrate. The first obtuse tangential angle β1 with respect to the mounting substrate 110 of the first reflector element 840*a* of the first light-shaping module 850 may be lower than the second obtuse tangential angle β2 of the second reflector element 840*b* of the first light-shaping module 850. In the exemplary embodiment of FIG. 8, the second light-shaping module 850' may have similar optical properties as the first light-shaping module 850. The third obtuse tangential angle β3 of the first reflector element 840*a*' of the second light-shaping module 850' may be equal to the first obtuse tangential angle β1; and the fourth obtuse tangential angle β4 of the second reflector element 840*b*' of the second light-shaping module 850' may be equal to the second obtuse tangential angle β2.

The skilled person will understand that the first and second light-shaping modules 850, 850' may have similar or different optical properties. In an exemplary embodiment, the first and second light-shaping modules 850, 850' have different lens elements. In another exemplary embodiment, the first and second obtuse tangential angles β1 and β2 of the first and second reflector elements 840*a*, 840*b* of the first light-shaping module 850 are equal, and have a lower value than the equal third and fourth obtuse tangential angles β3 and β4 of the first and second reflector elements 840*a*', 840*b*' of the second light-shaping module 850'. In still another exemplary embodiment, the first, second, third, and fourth obtuse tangential angles β1, β2, β3, and β4 have increasingly higher values as their mounting height is lower and lower. In still another exemplary embodiment, the first, second, third, and fourth obtuse tangential angles β1, β2, β3, and β4 are equal.

With respect to the first light-shaping module 850, adjacent light sources 820 mounted at different heights may be separated by a distance h1. With respect to the second light-shaping module 850', adjacent light sources 820' mounted at different heights may be separated by a distance h1'. The distances h1 and h1' may be similar or different. A light source 820 associated to the first light-shaping module 850 may be separated from an adjacent light source 820' associated to the second light-shaping module by a distance h2. The distance h1 may be lower than the distance h2, and the distance h1' may be lower than the distance h2. In this manner, influence of the first and second light-shaping modules 850, 850' on each other may be mitigated. Alternatively, the plurality and the another plurality of light sources 820, 820' may be mounted in an array with regular rows, and the distances h1, h1', and h2 may be equal.

Whilst the principles of the invention have been set out above in connection with specific embodiments, it is to be understood that this description is merely made by way of example and not as a limitation of the scope of protection which is determined by the appended claims.

The invention claimed is:

1. A lighting apparatus comprising:

a mounting substrate being arranged in the lighting apparatus at an angle below 45° with respect to a vertical direction;

a plurality of light sources mounted on a lower or vertical surface of the mounting substrate such that at least two light sources of the plurality of light sources are at a different height;

a plurality of lens elements provided to the mounting substrate such that each of the plurality of light sources is provided with a corresponding lens element;

at least two reflector elements provided to the at least two light sources, such that each of the at least two reflector elements has a reflective surface facing the mounting substrate;

wherein each of the at least two reflector elements extends between a first edge and a second edge;

wherein each of the at least two reflector elements first edge is being located above a corresponding light source of the at least two light sources as seen in a vertical direction;

wherein each of the at least two reflector elements second edge is being located below a corresponding light source of the at least two light sources as seen in a vertical direction.

2. The apparatus of claim 1, further comprising a lens plate integrating the plurality of lens elements; wherein the at least two reflector elements are mounted on the lens plate.

3. The apparatus of claim 1, wherein the plurality of light sources is arranged as an array of light sources with at least two rows of light sources and two columns of light sources.

4. The apparatus of claim 3, wherein one or each of the at least two reflector elements corresponds to at least two adjacent light sources of a row of light sources; and/or wherein one or each of the plurality of reflector elements corresponds to one lens element.

5. The apparatus of claim 1, wherein one or each of the at least two reflector elements is at a tangential angle with respect to the mounting substrate at the first edge of each of the plurality of reflector elements, said tangential angle being between 90° and 170° with respect to the mounting substrate.

6. The apparatus of claim 1, wherein a first reflector element of the at least two reflector elements is at a first obtuse tangential angle with respect to the mounting substrate lower than a second obtuse tangential angle of a second reflector element of the at least two reflector elements provided at a lower height; wherein the difference between the first and second obtuse tangential angle is at least 1%.

7. The apparatus of claim 1, wherein the mounting substrate is vertical.

8. The apparatus of claim 1, wherein one or each of the plurality of lens elements has a first surface and a second surface located on opposite sides thereof; wherein the first surface is a convex surface; wherein the second surface is a concave surface; and wherein the second surface extends over the corresponding light source.

9. The apparatus of claim 8, wherein at least one of said first surface and said second surface of one or each of the plurality of lens elements comprises a first curved surface and a second curved surface, said first curved surface being connected to said second curved surface through a connecting surface or line comprising a saddle point or discontinuity.

10. The apparatus of claim 9, wherein the first curved surface is located higher than the second curved surface as seen in a vertical direction, and wherein the saddle point or discontinuity is located below the corresponding light source as seen in a vertical direction, said saddle point or discontinuity being optionally comprised by the first surface of one or each of the plurality of lens elements.

11. The apparatus of claim 1, wherein one or each of the plurality of lens elements comprises a free form lens element.

12. The apparatus of claim 1, wherein one or each of the plurality of lens elements is configured for guiding at least 50% of the light emitted by the corresponding light source towards the reflective surface of the corresponding reflector element.

13. The apparatus of claim 12, wherein one or each of the plurality of lens elements is configured for guiding at most 45% of the light emitted by the corresponding light source below the second edge of the corresponding reflector element.

14. The apparatus of claim 13, wherein the plurality of lens elements associated and the at least two reflector elements are configured such that at least 55% of the light emitted by the at least two light sources is reflected by the at least two reflector elements.

15. The apparatus of claim 1, further comprising:

another plurality of light sources mounted on a lower or vertical surface of the mounting substrate such that another at least two light sources of the another plurality of light sources are at a different height, wherein the plurality of light sources and the another plurality of light sources are at a different height;

a first light-shaping module;

a second light-shaping module;

wherein the first light-shaping module comprises:

the plurality of lens elements; and the at least two reflector elements;

wherein the second light-shaping module comprises:

another plurality of lens elements provided to the mounting substrate such that each of the another plurality of light sources is provided with a corresponding lens element;

another at least two reflector elements provided to the another at least two light sources, such that each of the another at least two reflector elements has a reflective surface facing the mounting substrate;

wherein each of the another at least two reflector elements extends between a first edge and a second edge;

wherein each of the another at least two reflector elements first edge is being located above a corresponding light source of the another at least two light sources as seen in a vertical direction;

wherein each of the another at least two reflector elements second edge is being located below a corresponding light source of the another at least two light sources as seen in a vertical direction.

16. The apparatus of claim 15, wherein a first distance h1 between adjacent light sources at different heights associated with the first light-shaping module or second light-shaping module is lower than a second distance h2 between a light source associated with the first light-shaping module and another light source associated with the second light-shaping module at a different height.

17. A light pole module comprising:

a lighting apparatus according to claim 1;

a housing, said housing comprising an at least partially transparent or translucent sidewall facing the plurality of light sources, and said housing further comprising a lower end portion configured for being attached to a support pole.

18. A lamp post comprising a support pole and a light pole module according to claim 17.

19. The lamp post of claim 18, further comprising a functional module;

wherein the functional module and the light pole module are arranged one above the other, aligned with the support pole; and wherein the functional module comprises any one or more of the following:

an antenna configured for receiving and emitting cellular data;

power management circuitry configured to manage the provision of power to multiple lamp posts;

telecommunication circuitry;

audio system management circuitry;

WiFi circuitry;

charger circuitry;

an environmental sensor such as a microphone, a detector of $CO_2$, $NO_x$, or smoke, and the associated circuitry;

a human interface device (HID) and the associated circuitry, such as a camera, a loudspeaker, a button; or an image sensor and/or a camera and/or a video recorder.

20. A lighting apparatus comprising:

a mounting substrate being arranged in the lighting apparatus at an angle below 45° with respect to a vertical direction;

a plurality of light sources mounted on a lower or vertical surface of the mounting substrate such that at least two light sources of the plurality of light sources are at a different height;

a plurality of lens elements provided to the mounting substrate such that each of the plurality of light sources is provided with a corresponding lens element;

at least two reflector elements provided to the at least two light sources, such that each of the at least two reflector elements has a reflective surface facing the mounting substrate;

wherein each of the at least two reflector elements extends between a first edge and a second edge;

wherein each of the at least two reflector elements first edge is being located above a corresponding light source of the at least two light sources as seen in a vertical direction;

wherein each of the at least two reflector elements second edge is being located below a corresponding light source of the at least two light sources as seen in a vertical direction;

wherein one or each of the plurality of lens elements has a first surface and a second surface located on opposite sides thereof;

wherein at least one of said first surface and said second surface of one or each of the plurality of lens elements comprises a first curved surface and a second curved surface, said first curved surface being connected to said second curved surface through a connecting surface or line comprising a saddle point or discontinuity;

wherein the first curved surface is located higher than the second curved surface as seen in a vertical direction, and wherein the saddle point or discontinuity is located below the corresponding light source as seen in a vertical direction.

* * * * *